United States Patent [19]

Spaulding, Sr.

[11] 4,273,171

[45] Jun. 16, 1981

[54] DUAL ACTION COMBINATION FIREWOOD CUTTING AND SPLITTING MACHINE

[76] Inventor: Bert W. Spaulding, Sr., R.F.D. 1, Box 280, Claremont, N.H. 03743

[21] Appl. No.: 84,692

[22] Filed: Oct. 15, 1979

[51] Int. Cl.[3] ..... B27L 7/00

[52] U.S. Cl. ..... 144/193 A; 83/694; 83/928; 144/3 K; 254/104

[58] Field of Search ..... 254/104; 144/3 K, 193 R, 144/193 A; 83/694, 697, 928

[56] References Cited

U.S. PATENT DOCUMENTS

| | | | |
|---|---|---|---|
| 3,319,675 | 5/1967 | Bles, Sr. | 144/193 A |
| 3,974,867 | 8/1976 | Butas, Jr. | 144/193 A |
| 4,081,008 | 3/1978 | Dilling | 144/193 A |
| 4,141,396 | 2/1979 | McCallister | 144/193 A |

*Primary Examiner*—W. D. Bray

*Attorney, Agent, or Firm*—Sughrue, Rothwell, Mion, Zinn and Macpeak

[57] ABSTRACT

A thin, vertically oriented rectangular cutting blade having opposed vertical cutting edges and being reciprocated horizontally towards and away from opposite vertical stops, permits an end of a log to be inserted between given blade edges and stops during strokes in opposite directions, to sever the log into firewood length. Oppositely facing splitting wedges mounted to the blade just behind the cutting edges have their tapered splitting edges facing in the same direction as the blade edges for splitting the partially severed firewood length pieces into multiple sections prior to complete severance thereof from the log proper.

10 Claims, 9 Drawing Figures

DUAL ACTION COMBINATION FIREWOOD CUTTING AND SPLITTING MACHINE

BACKGROUND OF THE INVENTION

Attempts have been made to sever trees, tree sections, logs or limbs into firewood length pieces and subsequently split the short log sections into multiple firewood pieces. One such machine is disclosed in U.S. Pat. No. 4,076,061. The machine of that patent includes an endless carrier which feeds a log or tree forwardly into the path of a reciprocating guillotine type blade which severs the tree or log into short log sections of firewood length (capable of burning in a fireplace or wood stove). Whereupon, the severed firewood length log section drops into a position where a hydraulic ram drives the log section against a fixed multi-wedge multi-blade splitting element to split the severed log section into multiple pieces of firewood.

Such devices are relatively complicated, require timing in their operation, and are fairly expensive.

An earlier patent to Leo L. Heikkinen U.S. Pat. No. 3,862,651 teaches a similar device in which the log is initially severed by the utilization of a chain saw which oscillates across the path of the transported tree or log to section the log into relatively short length log sections which are then subsequently driven towards a fixed splitter assembly formed of wedges by a hydraulic ram or the like, to split the firewood length log section into firewood pieces.

The idea of utilizing a hydraulic motor as a means for effecting splitting of a log section lying in end-to-end alignment by driving a reciprocating splitting element such as multiple splitting blades into contact with the end of a relatively fixed log, is shown in U.S. Pat. No. 3,280,735 to Dagenais. In this case, the four right angle cutting knives achieve a four part split lengthwise of the log sections by blade penetration lengthwise of the right angle blades through the log from one end to the other.

While this machine acts satisfactorily to achieve the splitting of end-to-end log sections into four parts or pieces, the machines require initially, that the trees or limbs be severed into firewood length log sections prior to splitting.

It is, therefore, a primary object of the present invention to provide an improved dual acting mechanism for effecting simultaneously the severance of a tree limb or log into firewood length log sections and the splitting of that firewood length log section into multiple pieces by a single tool and with a simultaneous cutting and splitting action, and wherein the tool functions to automatically sever and split logs during each direction of reciprocation.

It is a further object of the present invention to provide an improved simultaneous firewood cutting and splitting machine in which the splitting action is initiated prior to the full severance of the firewood length section from the log proper and in which the number of split pieces for each firewood length log is normally in excess of two.

SUMMARY OF THE INVENTION

The invention is directed to a combined firewood log cutting and splitting machine, with the machine comprising a thin rectangular cutting blade vertically oriented and mounted for reciprocation horizontally and bearing at least one vertical cutting edge which moves towards and away from a vertical stop which defines with the cutting blade edge a guillotine cutting area. A tapered splitting wedge means is mounted to one side of the blade just rearwardly of the cutting edge, with the edge of the tapered wedge means on the side of the cutting blade opposite log insertion facing towards the stop such that a log inserted between the blade and the stop and in line with the splitting wedge means is initially partially severed by the cutting blade at right angles to its axis to form a partially severed log section and said section is subsequently split into multiple pieces by the wedge means prior to complete severance of the log into a log section of firewood length.

Preferably, the wedge means has a thickness about equal to the distance that the splitting edge of the wedge means is set back from the cutting edge of the blade. Further, preferably, the blade is dual acting, has dual vertical cutting edges and oppositely directed wedges provide splitting edges located just behind respective blade cutting edges on each side thereof. In one form, the wedge means comprises two separate wedges of triangular cross-section having their splitting edges directed away from each other and means are provided for adjustably mounting the dual wedges to one side of the cutting blade, in line and spaced apart from each other. Dual fluid cylinders may be employed for reciprocating the blade which is mounted for reciprocation between oppositely opposed rails on each side of the blade, at the top and bottom thereof. An inclined chute may be mounted to one side of the reciprocating blade and below the same such that the severed and split log sections may be deposited to the same side of the machine regardless of which cutting edge achieves the severance of the inserted log.

DESCRIPTION OF THE PREFERRED EMBODIMENT

Figure 1:
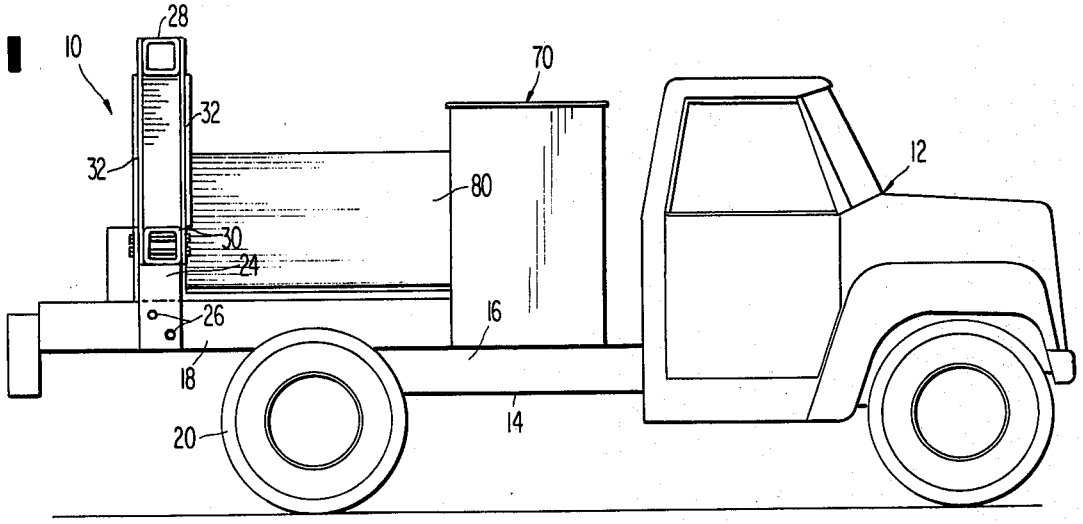
FIG. 1 is a side elevational view of a truck bearing one embodiment of the combined firewood log splitting and cutting machine of the present invention.

Referring to the drawings, the combined firewood log splitting and cutting machine is indicated generally at 10 in FIG. 1 and is shown as being vehicle mounted by way of a truck indicated generally at 12, although there is no necessity for such mounting, and the machine may be at a fixed location such as at a lumber mill site or the like. In the illustrated embodiment, the truck 12 constitutes a truck body 14 including a frame 16, upon which is mounted a truck bed 18 which extends rearwardly beyond rear wheels 20 of the vehicle. The bed 18 is defined by a pair of laterally opposed longitudinally extending box beams 22, FIG. 2, on the outside of which are bolted a pair of L-shaped vertical support plates 24 by means of bolts 26. Spanning between the plates 24 is an I-beam as at 28. Further, mounted to the support plates 24 and spanning across the width of the bed 18 is a lower box beam 30: an upper box beam 28 paralleling box beam 30, FIG. 1. The box beams bear opposed pairs of side plates, as at 32, on the right side of the truck body, FIG. 1. The side plates 24 terminate at their upper ends in right angle flange portions 24*a* which are bolted to opposed sides of the lower box beam 30 by bolts 34. Further, adjacent the left side of the machine 10 are longitudinally spaced, opposed pairs of vertical plates 36 and 38 which act to effectively mount a pair of hydraulic cylinders as at 40 and 42 which extend horizontally intermediate of the upper and lower box beams 28 and 30. Mounted to the bottom of the upper box beam 28 and the top of the lower box beam 30 are laterally opposed rectangular rails 44. Between the rails 44 is mounted a thin, rectangular cutting blade indicated generally at 46 and being of a vertical height slightly less than the vertical distance between the box beams 28 and 30. Thus, the rails 44 define a guide way for the reciprocating cutting blade 46.

The machine just beyond the ends of the rails 44 is provided with vertical plates or stops as at 48 and 50. Plate 48 extends laterally beyond the edges of the plates 32 while the plate 50 extends the full width of the laterally spaced plates 38 which bear that stop. The cutting blade 46, while mounted for reciprocation, does not abut either the stop 48 or the stop 50: the extent of reciprocation of the blade being limited and defined by the paired hydraulic cylinders 40 and 42. The cutting blade 46 is sharpened at both ends to define a right hand cutting edge 52 and a left hand cutting edge 54, the blade edges taper and are relatively sharp so as to readily pierce transversely and sever portions or sections of a log inserted alternatively between cutting edge 52 and stop 48 or between cutting edge 54 and stop 50 as indicated, respectively, in FIGS. 2 and 4.

Figure 7:
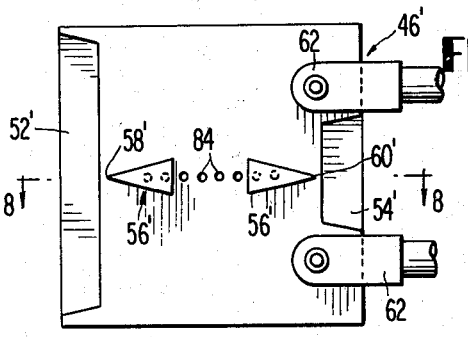
FIG. 7 is a vertical elevational view of an alternate form of cutting blade employed in the illustrated machine.
Figure 8:
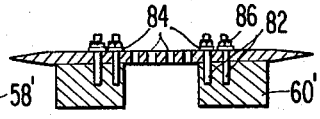
FIG. 8 is a horizontal sectional view of the cutting blade of FIG. 7, taken about line 8—8.
Figure 2:
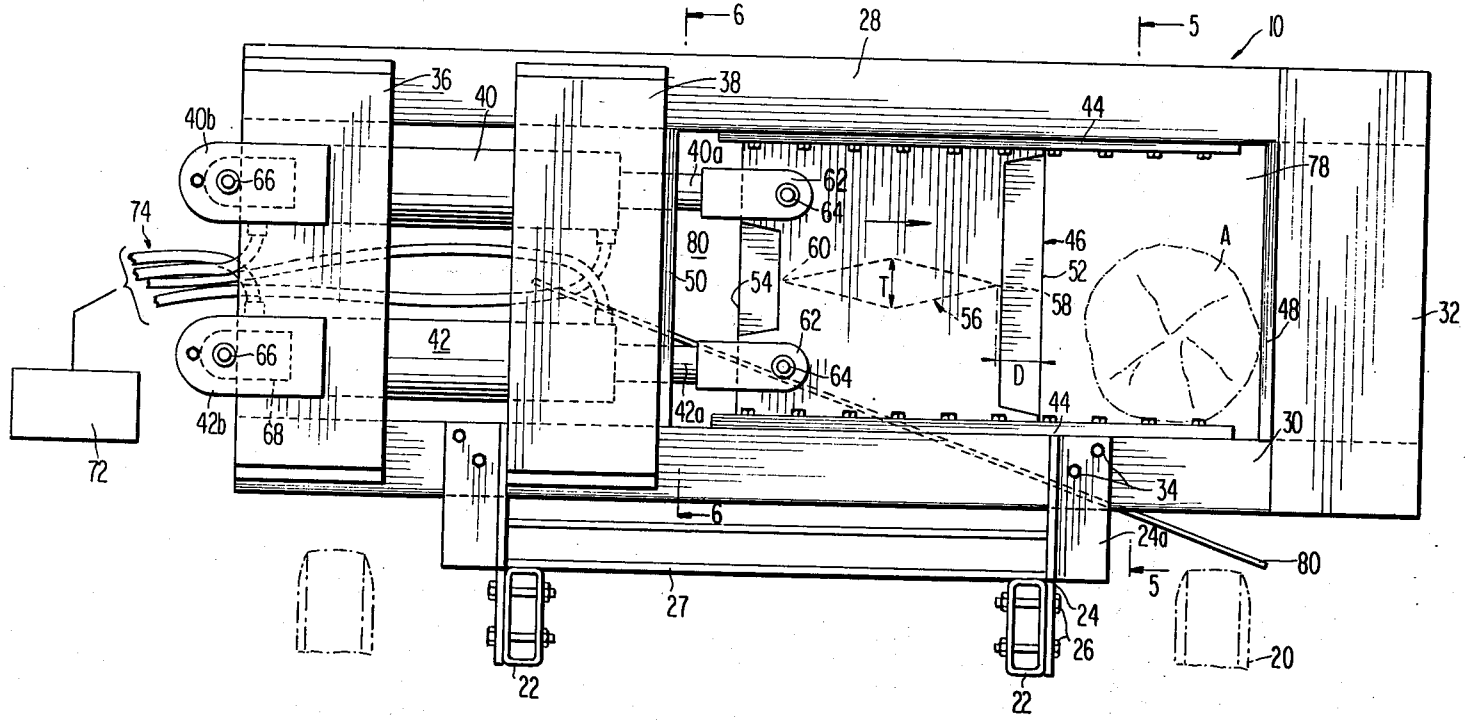
FIG. 2 is a rear elevational view of the machine of the present invention during cutting and splitting of a log section by the right hand cutting edge during reciprocation of the blade.
Figure 3:
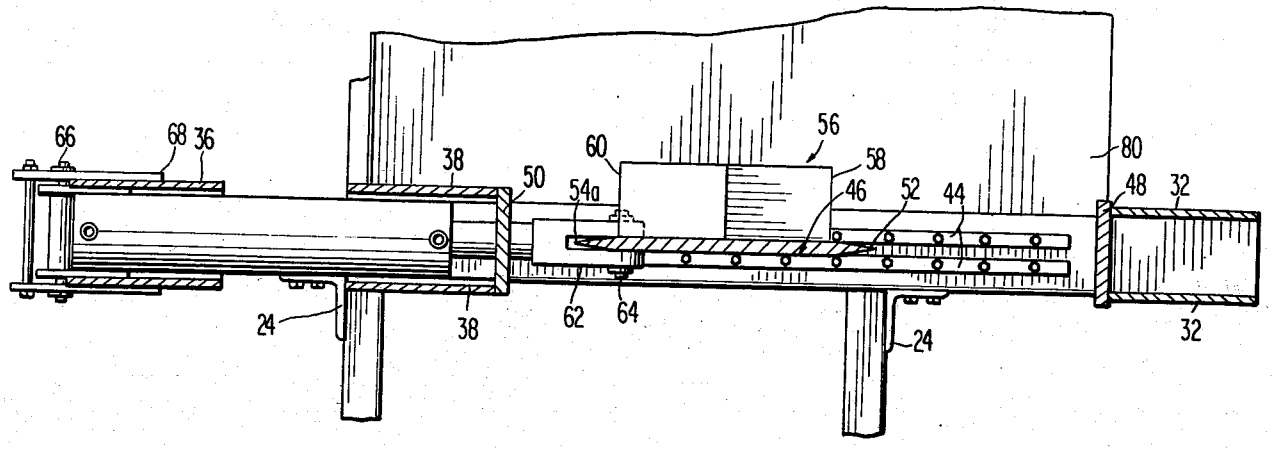
FIG. 3 is a horizontal sectional view of a portion of the machine shown in FIG. 2.

Important to the present invention is the provision of wedge means indicated generally at 56. In the embodiment of FIGS. 1–6, wedge means 56 is constituted by a single metal block of diamond shaped cross-section, tapering in opposite directions from its center and terminating in opposed, splitting wedge edges 58 and 60. In the illustrated embodiment of the invention, the wedge means 56 (whether it be a single element as shown in FIG. 2 or comprised of two separate wedges as indicated in FIGS. 7 and 8) has a thickness generally on the order of the distance D between each cutting edge 52, 54 of the cutting blade 46, and the associated splitting edges 58 and 60, respectively, of the wedge means 56. For instance, the splitting edge 58 of the wedge means 56 may be some three inches from the cutting edge 52 of the cutting blade and the thickness T of the wedge means 56 may be on the order of four inches.

The dual and opposite reciprocating action is effected by the use of the hydraulic cylinders 40 and 42. The hydraulic cylinders 40, 42 comprise projectable and retractable plungers or rods as at 40*a* and 42*a*, the rods being pivotably mounted to the cutting blade 46 by means of clevises 62 via connection pins 64, while the cylinder portions 40*b* and 42*b* of respective cylinders, are pivotably mounted to opposed plates 36 by connection pins 66 to plates 68. The pins 66 pass through and are supported by plates 68, which are in turn welded to the outside surfaces of the vertical plates 36.

Figure 4:
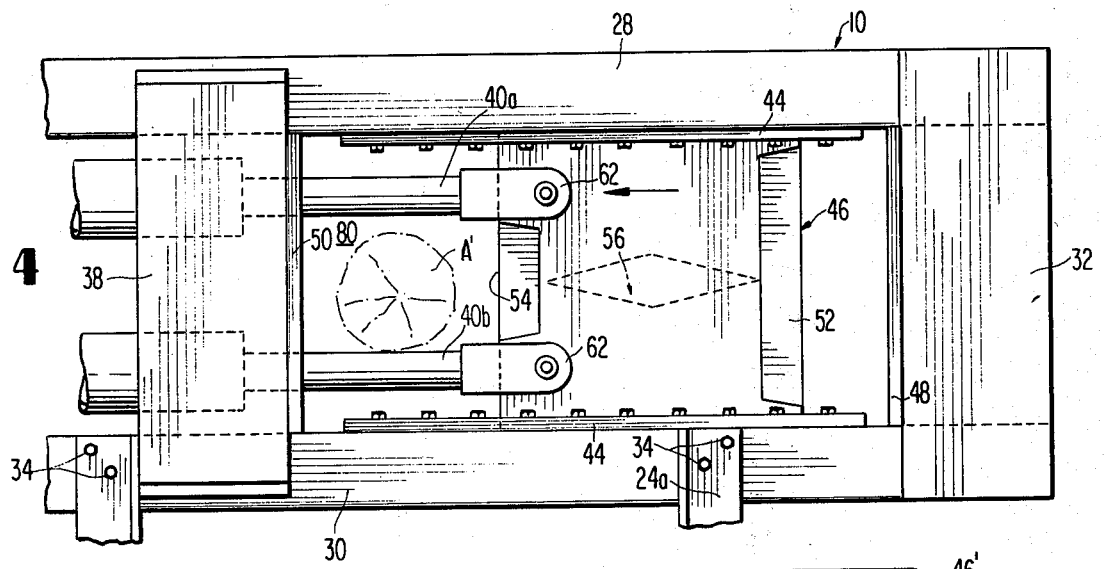
FIG. 4 is a rear elevational view of a portion of the machine, similar to that shown in FIG. 2, with the left hand cutting edge in position to cut and sever a log section from a log inserted in front of the left hand cutting edge of the reciprocating blade.
Figure 5:
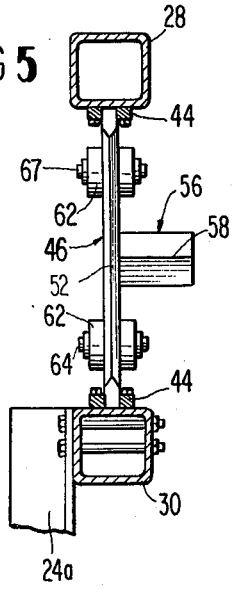
FIG. 5 is a vertical sectional view of the machine taken about line 5—5 of FIG. 2.
Figure 6:
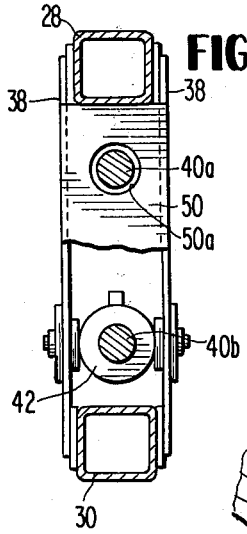
FIG. 6 is a vertical sectional view, partially broken away, of a portion of the machine taken about line 6—6 of FIG. 2.

In conventional fashion, a hydraulic liquid under appropriate pressure developed by a conventional hydraulic pump mechanism indicated generally at 70 (which in this case is mounted to the truck frame 16 behind the operator's cab) and activates a control apparatus indicated generally at 72, FIG. 4, is fed appropriately to the hydraulic cylinders 40 and 42 via lines 74 which also permit the return fluid to pass back to the pump mechanism 70, FIG. 2. Each hydraulic cylinder conventionally comprises a piston (not shown) operating within a closed cylinder, and wherein hydraulic liquid is applied to one side of the piston and removed from the other, and vice versa, to cause the pistons to reciprocate periodically in opposite directions and to thus cause the cutting blade 46 to move first towards the stop 48, decreasing the guillotine cutting area 78, FIG. 2, occupied by the moment by the log A, while enlarging the guillotine cutting area 80 between cutting edge 54 and stop 50 on the opposite side of the cutting blade 46. During reverse direction movement, that is, reciprocation from right to left as per FIG. 4, the cutting edge 54 contacts the re-inserted log A to sever from that log a log section of firewood length and to effect simultaneously full splitting of the log section into multiple pieces. The piston rods 40*a* and 42*a* pass through openings as at 50*a* within plate 50, without interference to the log which is inserted within the guillotine cutting area 80 intermediate of the rods 40*a* and 42*a*.

Figure 9:
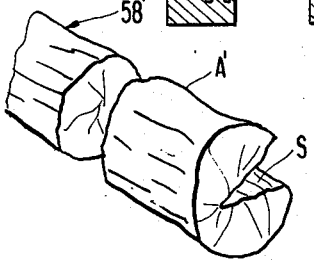
FIG. 9 is a perspective view of a log fully severed and partially split during reciprocation of the cutting blade of the present invention during machine operation as illustrated in FIG. 4.

The action of first initiating a partial cut, then initiating the splitting of the partially severed log section of firewood length, and completing severing and full splitting, may be seen by reference to FIG. 9. FIG. 9 shows the log A positioned corresponding to FIG. 2, at the time when full severance of the log A has been achieved to separate a firewood length section A′ from that log A, while at the same time effecting a partial split of the section A′ in firewood length pieces has been accomplished by means of the splitting edge 60 of the wedge means 50, which enters the log and splits it at that point into two sections. Viewed from the top, the log is inserted from the rear of the vehicle (in the case of the vehicle mounted machine), and it is only the partially severed log section that is impacted by the wedge splitting means 56. In actuality, the penetration of the splitting wedge means 56 into the log at the time that it is partially severed tends to cause the log section during complete severance by continued movement of the reciprocating cutting blade 46 to be split into more than two pieces, it may in fact split as many as six, seven or eight pieces, depending upon the nature of the wood at the area of penetration of the splitting edges 58 and 60 of the wedge means. At the time of severance, the remaining portion of log A may be moved to a position of alignment with the enlarged guillotine cutting area 78, FIG. 2, and that log may be inserted appropriately to a distance determined by the desired length of the firewood to be severed and split, whereupon, the reverse operation of hydraulic cylinders 40 and 42 will effect a change in direction of the cutting blade 46 from its movement from right to left and initiate a movement to the right as seen in FIG. 2. The inserted log is then severed and the severed portion is simultaneously split under the same sequence of operations as was the log section A' when the log was positioned within the guillotine cutting area 80 between cutting edge 54 and plate or stop 50 of machine 10, as illustrated. Preferably, an inclined chute or slide 80 is mounted to the bed 18, between the side plate 38 and the hydraulic pump unit 70, the chute 80 inclining downwardly and away from the truck body from the left side of the vehicle to the right, so as to discharge the severed and split firewood to the right of the vehicle. The chute 80 terminates above rear wheel 20 on the right side of that truck.

In an alternate form of the machine, the cutting blade 46', FIG. 7, is of identical configuration size, and is provided with opposed cutting edges as at 52' and 54'. However, in this case, instead of a single, unitary wedge means 56, there are two laterally opposed and spaced wedges as at 56', the wedges taking the form of two solid blocks of metal, triangular in cross-section, and each having a cutting edge as at 60' and 58', respectively. They are mounted to block 46' by means of threaded studs 82 which are bolted through appropriate holes as at 84 within the cutting blade 46' and are held thereon by means of lock nuts 86. In that embodiment of the invention, by the utilization of a series of aligned holes as at 84, the wedges 56' may be mounted closer together or further apart, although preferably the splitting edges 58' and 60' should be at the same distance from respective cutting edges 52' and 54' as in the embodiment of FIG. 4. In all other respects, the machine of the second embodiment is identical to that of the first embodiment, with the blade being mounted to the hydraulic cylinders in the same fashion by way of clevises as at 62.

It is important to note that in the present invention severance of the inserted log into firewood length pieces does not occur prior to the splitting of the log and in fact it is the cutting initiated prior to splitting that achieves the multiple splits of the severed firewood log section by the impact of the moving wedge splitting edges into the partially severed log section and the separation by splitting into more than two pieces achieved during the simultaneous termination of cutting and splitting.

As mentioned previously, the cutting and splitting machine is illustrated as being vehicle mounted, although this is not necessary and may not even be preferred. However, this permits the machine to be taken to the site of the downed tree rather than necessitating the transport of the logs after the trees have been downed from the wooded grove to a fixed machine location.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A combined reciprocating firewood log splitting and cutting machine, said machine comprising:

a thin, vertically oriented cutting blade mounted for horizontal reciprocation along a horizontal cutting path and bearing at least one vertical cutting edge, a stop positioned in the path of said cutting blade and defining with said cutting blade a guillotine cutting area for a log inserted within said cutting area, a relatively thick wedge means mounted to said cutting blade rearwardly of the cutting edge and projecting to one side thereof, opposite the side from which a log is inserted, and bearing a tapered splitting edge facing towards said stop with said tapered splitting edge positioned rearwardly of the cutting blade cutting edge; and means for reciprocating said blade towards and away from said stop to open and close said guillotine cutting area such that during closure of said area there results initial partial severance of a firewood length log section from said inserted log and subsequently, splitting only of said partially severed log section by said wedge means prior to complete severance of said log section from said inserted log.

2. The machine as claimed in claim 1, wherein said wedge has a thickness approximately equal to the distance of setback between the splitting edge of the wedge and the cutting edge of said blade.

3. The machine as claimed in claim 1, wherein said blade is a rectangular blade bearing oppositely directed vertical cutting edges on opposed ends thereof and said machine includes stops at both ends facing said edges, and said wedge means comprises oppositely directed tapered splitting edges terminating just behind the respective cutting edges, such that a log inserted between each cutting edge and a respective stop is severed and split by an initial cutting action due to penetration of the cutting edge and subsequent splitting of the log into multiple pieces by said contact of the wedge splitting edge, prior to complete severance thereof by the cutting edge under guillotine action.

4. The machine as claimed in claim 3, wherein said wedge means comprises separate triangular shaped wedges and means for adjustably mounting said separate triangular shaped wedges to the side of said cutting blade at longitudinally spaced positions so as to permit a variation in the spacing between the splitting edges of the separate wedges and the cutting edges on opposite sides of said reciprocating blade.

5. The machine as claimed in claim 3, wherein a pair of hydraulic cylinders bear rods at one end clevis mounted to said blade for reciprocating said blade along said horizontal path, and wherein said rods are fixed to said blade adjacent the upper and lower ends of said blade, such that a log inserted between the hydraulic cylinder rods is impacted in sequence by the cutting edge carried by that side of said blade and said wedge means.

6. The machine as claimed in claim 4, wherein a pair of hydraulic cylinders bear rods at one end clevis mounted to said blade for reciprocating said blade along said horizontal path, and wherein said rods are fixed to said blade adjacent the upper and lower ends of said blade, such that a log inserted between the hydraulic cylinder rods is impacted in sequence by the cutting edge carried by that side of said blade and said wedge means.

7. The machine as claimed in claim 1, further comprising an inclined chute fixedly mounted to one side of said reciprocating blade and generally below the path of movement of the cutting blade such that upon severance of the log into firewood sections and splitting of said sections into pieces, the split firewood length pieces contact the inclined chute and are gravity deposited to one side of the cutting blade and away from guillotine cutting areas.

8. The machine as claimed in claim 3, further comprising an inclined chute fixedly mounted to one side of said reciprocating blade and generally below the path of movement of the cutting blade such that upon severance of the log into firewood sections and splitting of said sections into pieces, the split firewood length pieces contact the inclined chute and are gravity deposited to one side of the cutting blade and away from guillotine cutting areas.

9. The machine as claimed in claim 4, further comprising an inclined chute fixedly mounted to one side of said reciprocating blade and generally below the path of movement of the cutting blade such that upon severance of the log into firewood sections and splitting of said sections into pieces, the split firewood length pieces contact the inclined chute and are gravity deposited to one side of the cutting blade and away from guillotine cutting areas.

10. The machine as claimed in claim 5, further comprising an inclined chute fixedly mounted to one side of said reciprocating blade and generally below the path of movement of the cutting blade such that upon severance of the log into firewood sections and splitting of said sections into pieces, the split firewood length pieces contact the inclined chute and are gravity deposited to one side of the cutting blade and away from guillotine cutting areas.

* * * * *